US010438564B2

(12) United States Patent
Cote et al.

(10) Patent No.: US 10,438,564 B2
(45) Date of Patent: Oct. 8, 2019

(54) CONTENT-BASED STATISTICS FOR AMBIENT LIGHT SENSING

(71) Applicant: Apple Inc., Cupertino, CA (US)

(72) Inventors: Guy Cote, San Jose, CA (US); Mahesh B. Chappalli, San Jose, CA (US); Venu M. Duggineni, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/005,320

(22) Filed: Jun. 11, 2018

(65) Prior Publication Data

US 2018/0293958 A1 Oct. 11, 2018

Related U.S. Application Data

(63) Continuation of application No. 14/871,869, filed on Sep. 30, 2015, now Pat. No. 9,997,137.

(51) Int. Cl.

| | |
|---|---|
| ***G09G 5/10*** | (2006.01) |
| ***G09G 3/3225*** | (2016.01) |
| ***G09G 5/30*** | (2006.01) |
| ***G09G 3/20*** | (2006.01) |
| *G09G 3/34* | (2006.01) |

(52) U.S. Cl.

CPC ..... *G09G 5/10* (2013.01); *G09G 3/20* (2013.01); *G09G 3/3225* (2013.01); *G09G 5/30* (2013.01); *G09G 3/3406* (2013.01); *G09G 2320/062* (2013.01); *G09G 2320/0626* (2013.01); *G09G 2320/0673* (2013.01); *G09G 2360/12* (2013.01); *G09G 2360/144* (2013.01); *G09G 2360/148* (2013.01); *G09G 2360/16* (2013.01)

(58) Field of Classification Search

CPC .. G09G 5/30; G09G 3/3406; G09G 2320/062; G09G 2320/0626; G09G 2360/144; G09G 2360/148; H04N 1/00835; H04N 5/58

See application file for complete search history.

(56) References Cited

U.S. PATENT DOCUMENTS

| | | | |
|---|---|---|---|
| 8,531,379 B2 | 9/2013 | Kerofsky | |
| 8,817,002 B2 | 8/2014 | Robinson et al. | |
| 9,019,253 B2 | 4/2015 | Drzaic | |
| 9,997,137 B2 * | 6/2018 | Cote | G09G 3/3225 |

(Continued)

FOREIGN PATENT DOCUMENTS

| | | |
|---|---|---|
| JP | 2012128206 A | 7/2012 |
| WO | 2012089849 A1 | 7/2012 |

(Continued)

OTHER PUBLICATIONS

Machine Translated SPEC of JPWO2013102952 (Okuda et al.) Jul. 2013.

(Continued)

*Primary Examiner* — Antonio A Caschera

(74) *Attorney, Agent, or Firm* — Fletcher Yoder P.C.

(57) ABSTRACT

An electronic display includes a display side and an ambient light sensor configured to measure received light received through the display side. The electronic display also includes multiple pixels located between the display side and the ambient light sensor. The multiple pixels are configured to emit display light through the display side.

18 Claims, 10 Drawing Sheets

(56) References Cited

U.S. PATENT DOCUMENTS

| | | | |
|---|---|---|---|
| 2004/0095402 | A1 | 5/2004 | Nakano |
| 2010/0201275 | A1 | 8/2010 | Cok et al. |
| 2012/0212467 | A1 | 8/2012 | Kohtoku |
| 2014/0267202 | A1 | 9/2014 | Zheng |

FOREIGN PATENT DOCUMENTS

| | | | |
|---|---|---|---|
| WO | 2013102952 | A | 7/2013 |
| WO | WO2013102952 | A1 | 7/2013 |

OTHER PUBLICATIONS

Invitation and Partial Search Report for PCT Application No. PCT/US2016/048865 dated Nov. 10, 2016; 6 pgs.

* cited by examiner

CONTENT-BASED STATISTICS FOR AMBIENT LIGHT SENSING

CROSS-REFERENCE TO RELATED APPLICATIONS

This application is a continuation of U.S. Pat. No. 9,997,137, entitled Content-Based Statistics for Ambient Light Sending, filed Sep. 30, 2015, which is incorporated by reference in its entirety for all purposes.

BACKGROUND

The present disclosure relates generally to techniques for displaying images and, more particularly, to techniques for obtaining content-based statistics for ambient light sensing.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Ambient light sensors may be used to determine information about light around electronic devices to enable the devices to be deployed efficiently. For example, a brightness intensity setting of an electronic display may be determined based on how bright ambient light is around the electronic device. However, these ambient light sensors may use space that may be limited in small, compact devices. Moreover, placing the ambient light sensors in areas that are sensitive to light emitted by an electronic display may lead to inaccurate determinations of the ambient light.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

As previously discussed, an ambient light sensor may be used in an electronic device to determine an amount of light present around the electronic device. With an accurate estimate of the ambient lighting around an electronic display of an electronic device, brightness and/or backlight settings of the electronic display may be adjusted appropriately given the surroundings of the electronic display. However, an ambient light sensor may take space that is limited in relatively small devices. Accordingly, the ambient light sensor may be placed behind or under a display screen, especially when the display a display that does not use a backlight (e.g., a self-emissive display such as an organic light emitting diode (OLED) display). However, in addition to ambient light, the ambient light sensor may be sensitive to light emitted by the pixels (e.g., OLEDs) of the display. In other words, the brightness of displayed content may affect the ambient light sensor measurement.

Accordingly, the brightness value measured by the ambient light sensor may be adjusted based at least in part on the displayed content. More specifically, a brightness value for one or more concentric and overlapping or adjacent windows in an image frame may be determined to facilitate determining context for the displayed content. In some embodiments, the brightness value of a window may be determined by converting gamma corrected pixel values to a linear space, weighting R, G, and B pixel values, and summing the weighted pixel values to determine the brightness value (e.g., luminance Y) for the window. As such, based on the programmable number and location of the windows, the effect of content that is being displayed near the ambient light sensor may be determined and, thus, compensated for in ambient light sensor measurements. In other words, ambient light sensor measurements may compensate for displayed images by taking into account the content being displayed near the ambient light sensor, and the luminance detected by the ambient light sensor that may be attributed to the display.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As previously discussed, ambient light sensors may be used in electronic devices to determine light around an electronic device. This light information may be used to control brightness of displayed pixels and/or backlight settings. However, an ambient light sensor may take space that is limited in a relatively small device or that may have a relatively small bezel. Accordingly, the ambient light sensor may be placed behind or under a display screen (e.g., organic light emitting diode displays). However, in addition to ambient light, the ambient light sensor may pick up light emitted by the pixels (e.g., OLEDs) of the display. In other words, brightness of displayed content may affect the ambient light sensor measurement.

Accordingly, the brightness value measured by the ambient light sensor may be adjusted based at least in part on the displayed content. More specifically, a brightness value for one or more concentric and/or overlapping windows in an image frame may be determined to facilitate determining context for the displayed content. In some embodiments, the brightness value of a window may be determined by converting gamma corrected pixel values to a linear space, weighting R, G, and B pixel values, and summing the weighted pixel values to determine the brightness value (e.g., luminance Y of Y'UV formatting) for the window. As such, based on the programmable number and location of the windows, context into what and where content is being displayed may be determined and, thus, compensated for in ambient light sensor measurements. In other words, ambient light sensor measurements may be compensated for displayed images by taking into account where the ambient light sensor is located in relation to the displayed content and the luminance detected by the ambient light sensor that may be attributed to the display.

Figure 1:
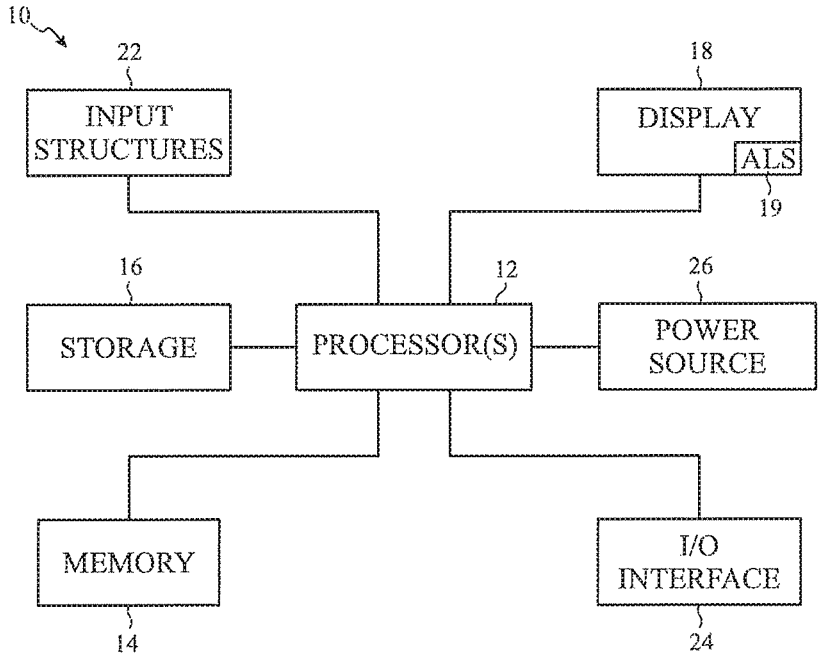
FIG. 1 is a schematic block diagram of an electronic device including display control circuitry, in accordance with an embodiment.

With these features in mind, a general description of suitable electronic devices that may use variable VCOM control with two or more VCOM amplifiers. Turning first to FIG. 1, an electronic device 10 according to an embodiment of the present disclosure may include, among other things, one or more processor(s) 12, memory 14, nonvolatile storage 16, a display 18, ambient light sensor 19, input structures 22, an input/output (I/O) interface 24 and a power source 26. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

Figure 2:
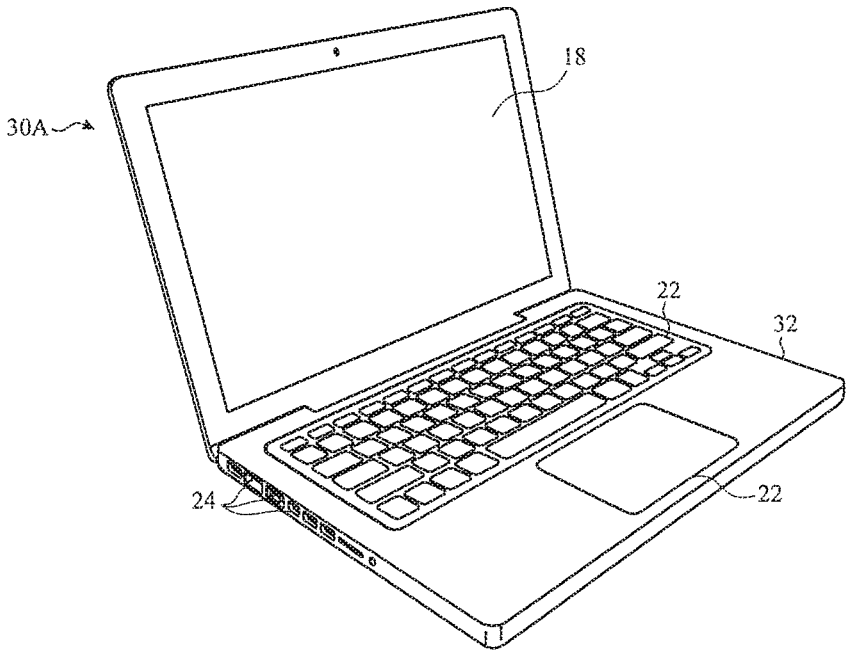
FIG. 2 is a perspective view of a notebook computer representing an embodiment of the electronic device of FIG. 1, in accordance with an embodiment.
Figure 3:
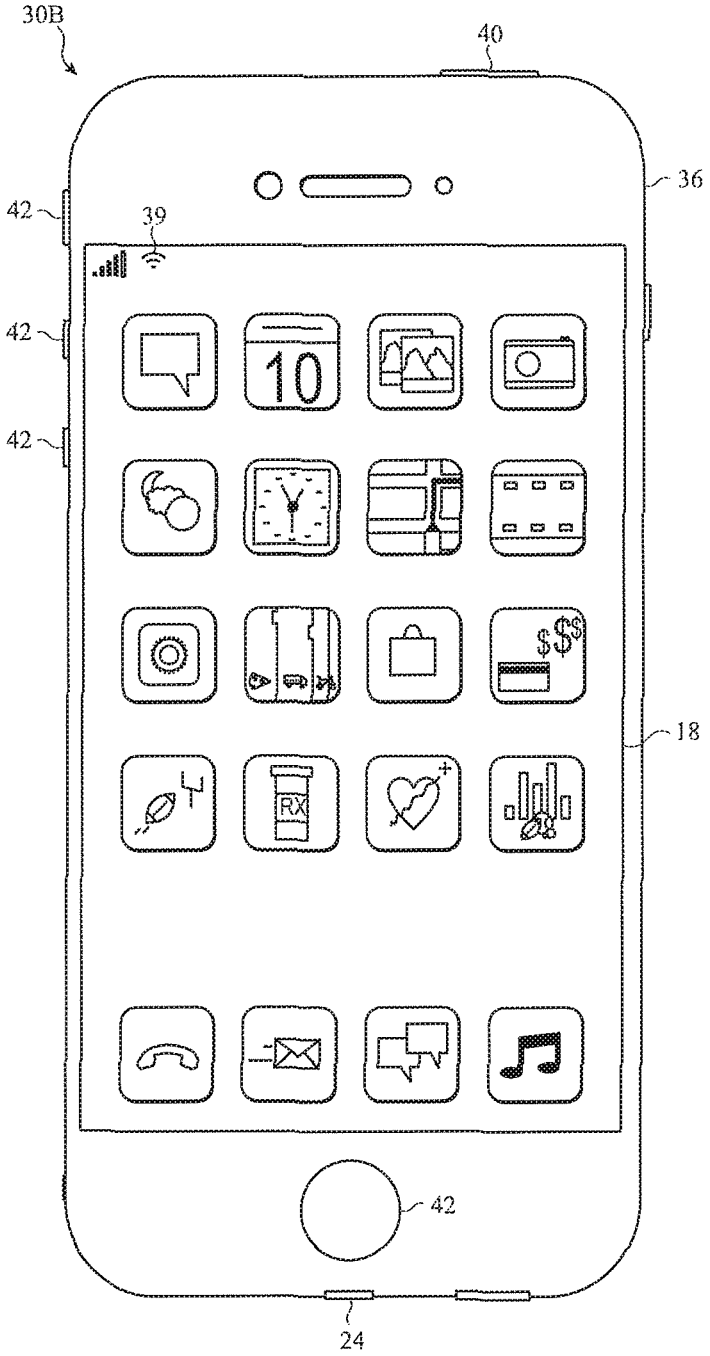
FIG. 3 is a front view of a hand-held device representing another embodiment of the electronic device of FIG. 1, in accordance with an embodiment.
Figure 4:
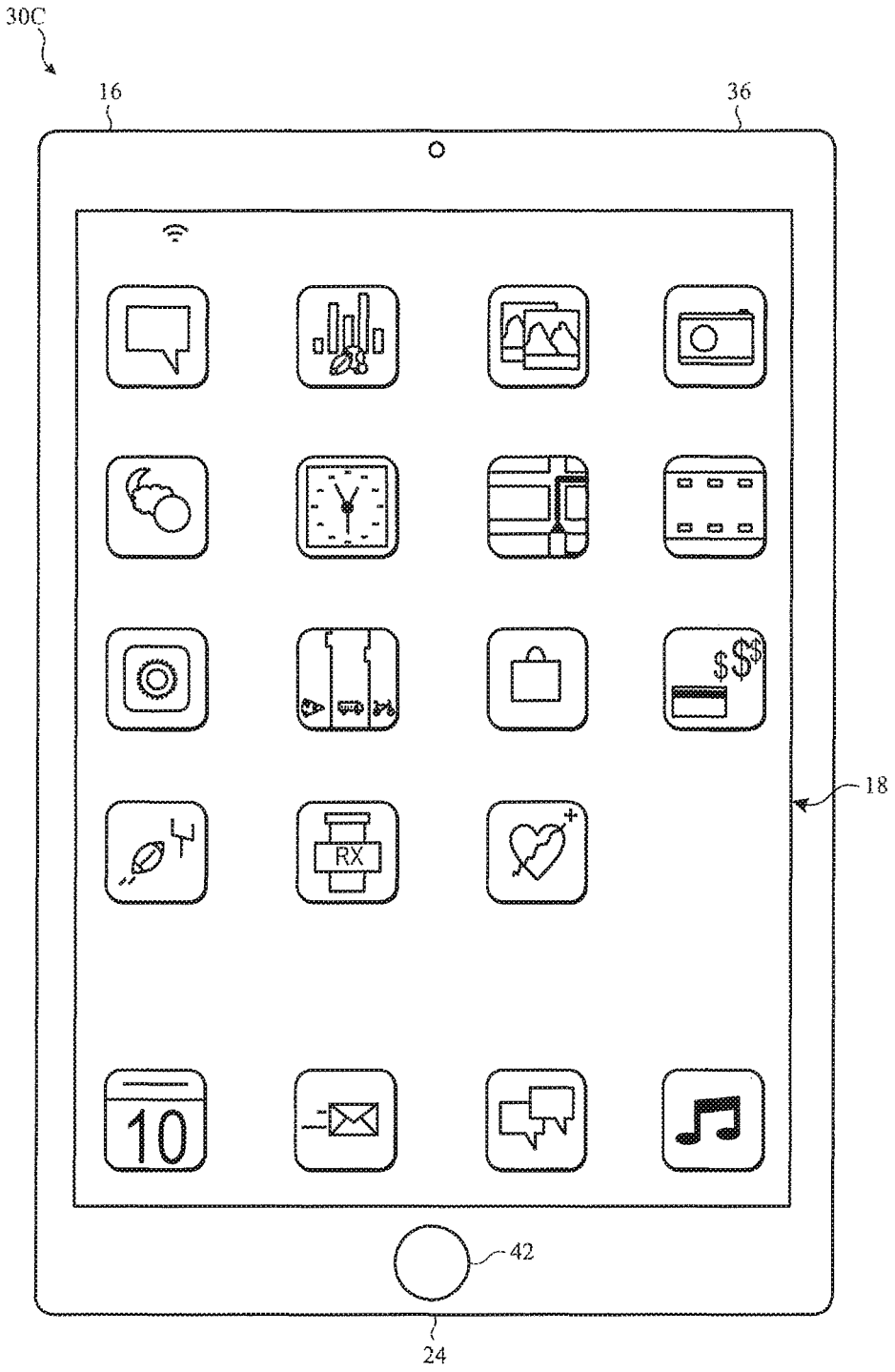
FIG. 4 is a front view of another hand-held device representing another embodiment of the electronic device of FIG. 1, in accordance with an embodiment.
Figure 5:
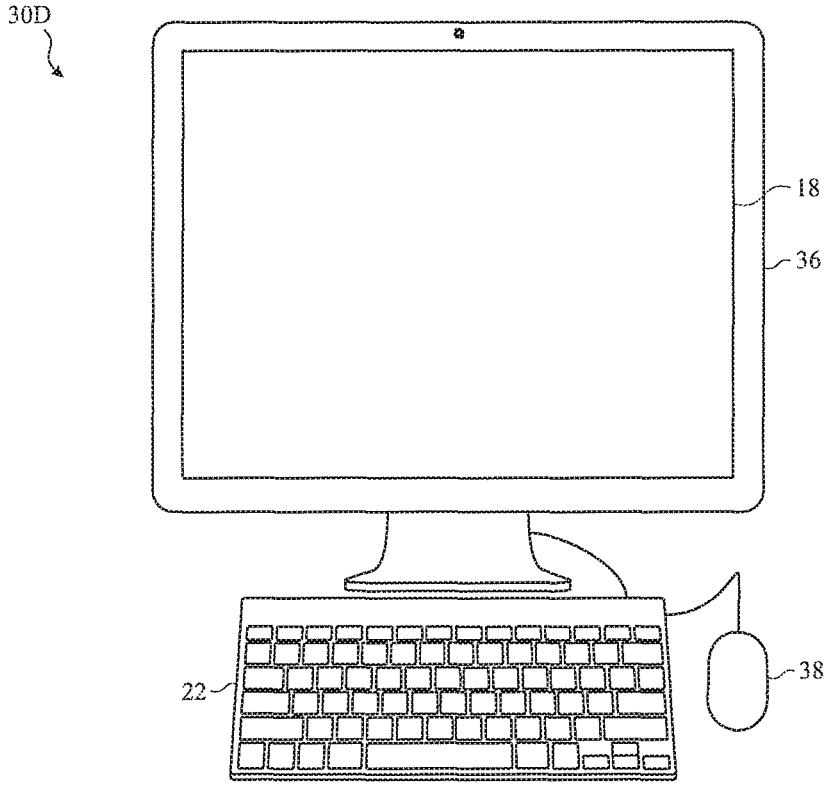
FIG. 5 is a front view of a desktop computer representing another embodiment of the electronic device of FIG. 1, in accordance with an embodiment.
Figure 6:
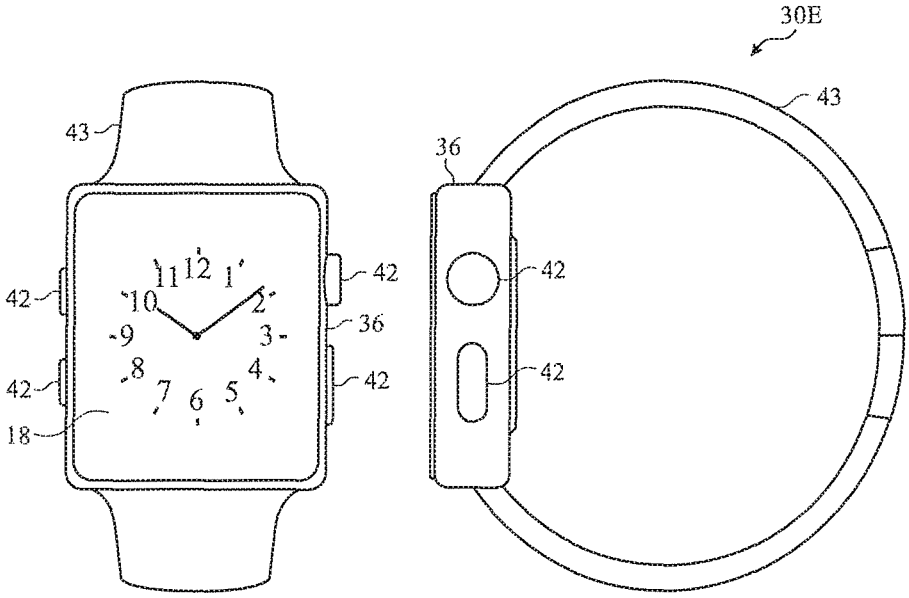
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile memory 16 to perform various algorithms. Such programs or instructions, including those for executing the techniques described herein, executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., e.g., an operating system) encoded on such a computer program product may also include instructions that may be executed by the processor(s) 12 to enable the electronic device 10 to provide various functionalities.

In certain embodiments, the display 18 may be an organic light emitting diode (OLED) or other type of self-emissive electronic display. In some embodiments, the display 18 may include a touch screen, which may allow users to interact with a user interface of the electronic device 10. As discussed below, the display 18 also includes an ambient light sensor 19 that is located within and/or under the display 18. As discussed below, such an arrangement of the ambient light sensor 19 causes the ambient light sensor 19 to capture luminance from the display 18 as well as ambient light around the display 18. Accordingly, the electronic device 10 may determine information about a displayed image to determine whether the displayed image is changing luminance levels detected at the ALS 19.

The input structures 22 of the electronic device 10 may enable a user to interact with the electronic device 10 (e.g., e.g., pressing a button to increase or decrease a volume level). The I/O interface 24 may enable electronic device 10 to interface with various other electronic devices. The I/O interface 24 may include various types of ports that may be connected to cabling. These ports may include standardized and/or proprietary ports, such as USB, RS232, Apple's Lightning® connector, as well as one or more ports for a conducted RF link. The I/O interface 24 may also include, for example, interfaces for a personal area network (e.g., PAN), such as a Bluetooth network, for a local area network (e.g., LAN) or wireless local area network (e.g., WLAN), such as an 802.11x Wi-Fi network, and/or for a wide area network (e.g., WAN), such as a $3^{rd}$ generation (e.g., 3G) cellular network, $4^{th}$ generation (e.g., 4G) cellular network, or long term evolution (e.g., LTE) cellular network. The I/O interface 24 may also include interfaces for, for example, broadband fixed wireless access networks (e.g., WiMAX), mobile broadband Wireless networks (e.g., mobile WiMAX), and so forth.

As further illustrated, the electronic device 10 may include a power source 26. The power source 26 may include any suitable source of power, such as a rechargeable lithium polymer (e.g., Li-poly) battery and/or an alternating current (e.g., AC) power converter. The power source 26 may be removable, such as replaceable battery cell.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of the I/O interface 24. In one embodiment, the input structures 22 (e.g., such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a connector and protocol, such as the Lightning connector provided by Apple Inc., a universal serial bus (e.g., USB), one or more conducted RF connectors, or other connectors and protocols.

User input structures 40 and 42, in combination with the display 18, may allow a user to control the handheld device 30B. For example, the input structure 40 may activate or deactivate the handheld device 30B, one of the input structures 42 may navigate user interface to a home screen, a user-configurable application screen, and/or activate a voice-recognition feature of the handheld device 30B, while other of the input structures 42 may provide volume control, or may toggle between vibrate and ring modes. Additional input structures 42 may also include a microphone may obtain a user's voice for various voice-related features, and a speaker to allow for audio playback and/or certain phone capabilities. The input structures 42 may also include a headphone input to provide a connection to external speakers and/or headphones and/or other output structures.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (e.g., PC) by another manufacturer. A similar enclosure 36 may be provided to protect and enclose internal components of the computer 30D such as the dual-layer display 18. In certain embodiments, a user of the computer 30D may interact with the computer 30D using various peripheral input devices, such as the keyboard 22 or mouse 38, which may connect to the computer 30D via a wired and/or wireless I/O interface 24.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., e.g., pedometer, accelerometer, heart rate monitor), or other device by another manufacturer. The display 18 of the wearable electronic device 30E may include a touch screen (e.g., e.g., LCD, OLED display, active-matrix organic light emitting diode (e.g., AMOLED) display, and so forth), which may allow users to interact with a user interface of the wearable electronic device 30E.

As noted above, an ambient light sensor may be placed under a display, but the brightness values around the ambient light sensor may interfere with such sensing unless compensated for. Accordingly, the brightness value measured by the sensor may be adjusted based at least in part on the displayed content. More specifically, a brightness value for one or more windows in an image frame may be determined to facility determining context for the displayed content. In some embodiments, the brightness value of a window may be determined by converting gamma corrected pixel values to a linear space, weighting the pixel values of various colors (e.g., R, G, and B pixel values in an RGB display or the R, G, B, and W pixel values in an RGBW display), and summing the weighted pixel values to determine the brightness value for the window. As such, based on the programmable number and location of the windows, context into what and where content is being displayed may be determined and thus, compensated for in the ambient light sensor measurement. In fact, this may enable taking into account where the sensor is located in relation to the displayed content.

Figure 7:
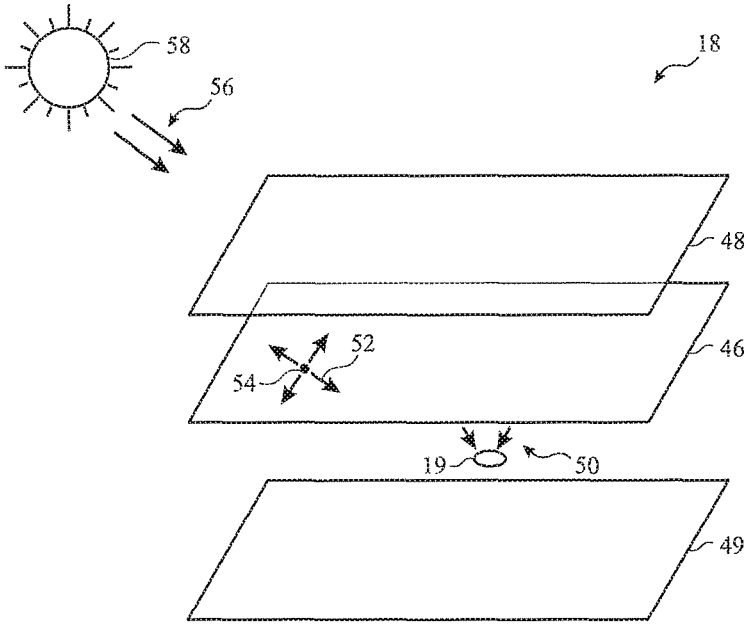
FIG. 7 is a partially exploded view of a display having an active area and an ambient light sensor, in accordance with an embodiment.

FIG. 7 illustrates a partially exploded view of the display 18. As illustrated, the display 18 includes the ambient light sensor 19 located below or under a display pixel layer 46. The display pixel layer 46 may include a layer made up of a matrix of organic light emitting diodes (OLED), liquid crystal diodes (LCDs), other pixel matrices that may be used to transmit video images, or any combination thereof. The display 18 also includes a protective layer 48. The protective layer 48 includes a substantially transparent material (e.g., glass) that allows the display 18 to transmit light from the display pixel layer 48 to a targeted location or user while protecting the display pixel layer 48 from outside particulates and other items that may interfere with operation of the display pixel layer. The protective layer 48 forms a display side of the display that transmits images. The display 18 also includes a bottom (or back) surface 49. The bottom surface 49 may be at least partially opaque. However, when the display 18 is substantially transparent (e.g., transparent OLED displays), the bottom surface 49 may be substantially transparent, as well. In other words, these displays may have two display sides.

The ambient light sensor 19 is subjected to light 50 from which the ambient light sensor 19 may sense luminance levels. However, the light 50 may include both display light 52 from one or more pixels 54 and outside light 56 from one or more outside light sources 58 (e.g., sun, light fixtures, etc.) The outside light 56 may also be referred to as the ambient light. The electronic device 10 may adjust the brightness of the electronic display 18 based on the ambient light. Since the light detected by the ambient light sensor 19 may include both the ambient outside light 56 as well as display light 52, however, the electronic device 10 may use the techniques discussed below to estimate the display light 52 part of the light 50. By subtracting the estimate of the display light 52 from the detected amount of light 50, the ambient outside light 56 may be ascertained. It is this ambient outside light 56 that may be used to appropriately adjust the display brightness of the electronic display 18.

Figure 8:
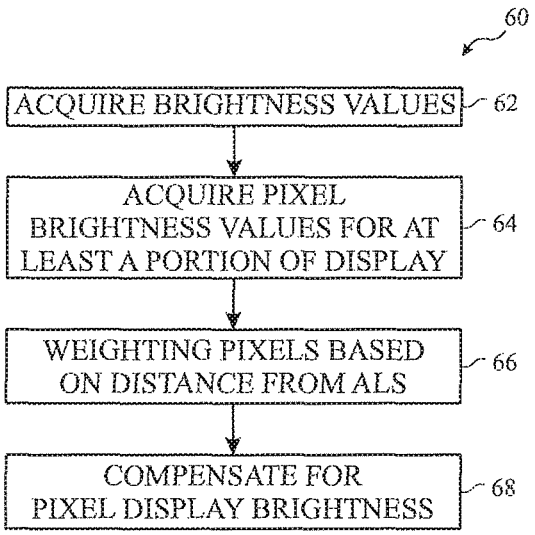
FIG. 8 is block diagram of a process for compensating for receiving light from the active area of FIG. 7 proximate to the ambient light sensor of FIG. 7, in accordance with an embodiment.

FIG. 8 illustrates a process 60 for deriving ambient light data using an ambient light sensor 19 located behind the display 18. The process 60 comprises using an ambient light sensor 19 located underneath an active area (e.g., display pixel layer 48) of the display 18 to acquire brightness values (e.g., luminance Y) in image data (block 62). The process 60 also includes determining brightness values of display pixels around the location of the ambient light sensor (block 64). Additionally, the process 60 includes weighting brightness values near the ambient light sensor differently than further brightness values of display pixels further from the ambient light sensor (block 66). For example, pixels closer to ambient light sensor 19 may be weighted more heavily in calculations while pixels further away from ambient light sensor 19 may be weighted less or not at all. In some embodiments, the weighting and the determining step may be performed simultaneously. For example, sub-regions of the display 18 (e.g., boxes, spheres, etc.) may be used to capture the brightness data for a display frame and add to a table to determine brightness values. For example, the processor 12 may determine image data for an image to be displayed from a buffer (e.g., frame buffer) before and/or during display of the image to determine brightness levels for pixels near the ambient light sensor 19. Moreover, the pixels closer to the ambient light sensor 19 may be captured in more sub-regions of the display 18 while further pixels may be captured in less sub-regions of the display 18. When the cumulative data for all the sub-regions of the display 18 are compiled, the closer pixels are given more weight (e.g., by being summed more times due to capture in multiple sub-regions) while the further pixels are given less weight (e.g., by being captured in less sub-regions than the closer pixels). Using the weighted brightness values, compensate for the brightness values of the display pixels to determine a compensated ambient light reading (block 68). The compensated ambient light reading may reduce or eliminate display noise from the display pixels to determine ambient light data. For example, the summed brightness values from the surrounding pixels may be subtracted from raw ambient light data captured by the ambient light sensor 19.

Figure 9:
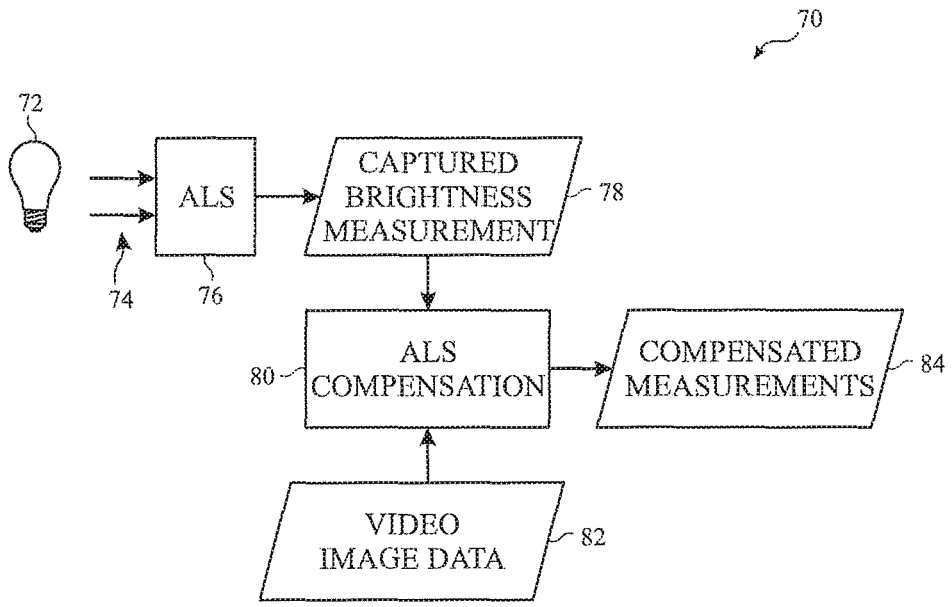
FIG. 9 illustrates schematic diagram of an ambient light sensor compensation system including ambient light sensor compensation logic, in accordance with an embodiment.

FIG. 9 illustrates schematic diagram of an ambient light sensor compensation system 70. One or more light sources 72 emit light 74. The light sources 72 may include the display 18, a light fixture, the sun, and/or other sources that may transmit light. The light 74 is received by the ambient light sensor 76. The ambient light sensor 76 transformed the electromagnetic waves of the light 74 into captured brightness measurements 78 that indicates luminance captured at the ambient light sensor 76. The ambient light sensor 76 passes the captured brightness measurements 78 to the ambient light sensor compensation logic 80. The ambient light sensor compensation logic 80 may include a processor executing instructions, a hardware implementation, or some combination thereof. The ambient light sensor compensation logic 80 also receives video image data 82. In some embodiments, the video image data 82 may be the same data that is used to write images to the display 18. Additionally or alternatively, the video image data 82 may also include a summation of brightness values in image data as previously discussed in reference to FIG. 8. In other words, the processor 12 may derive the summation of brightness values in image data using two or more overlapping regions where each of the regions adds brightness values in image data such that pixels that are located in more than one region are counted more than once. Thus, pixels that are closer to the ambient light sensor 76 are weighted more heavily to compensate more heavily for such pixels. The ambient light sensor compensation logic 80 then subtracts the summations based at least in part on the video image data 82. For example, the subtractions may be done directly using the video image data 82 or used to generate the summations using the ambient light sensor compensation logic 80. Therefore, the ambient light sensor compensation logic 80 reduces or eliminates display luminance effects from the captured brightness measurements 78 to provide more accurate ambient light readings.

Figure 10:
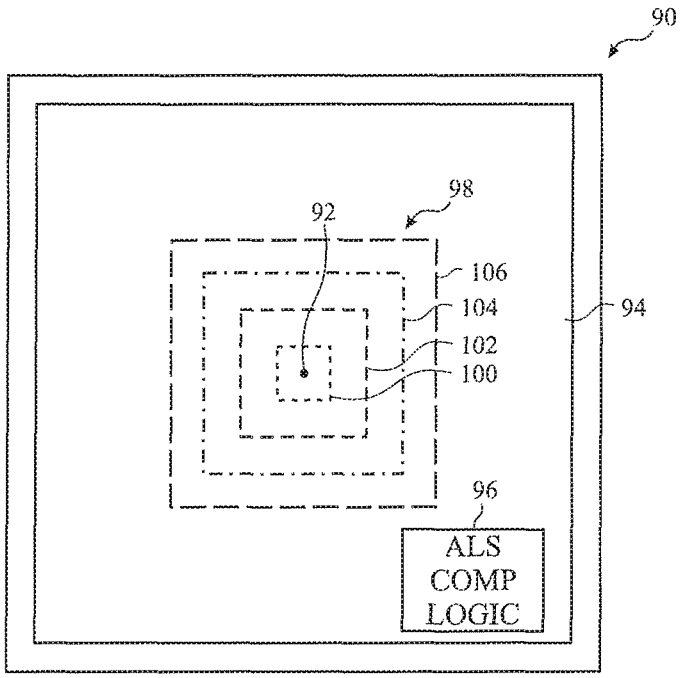
FIG. 10 illustrates a display with an ambient light sensor located behind/under an active area for the display with rectangular regions, in accordance with an embodiment.

FIG. 10 illustrates a display 90 with an ambient light sensor 92 located behind/under an active area 94 (e.g., display pixels) for the display. The ambient light sensor 92 is configured to capture brightness levels at the ambient light sensor 92 that indicate ambient light levels. However, the ambient light sensor 92 captures light from the display 90 as well since ambient light and displayed light are both located in a same direction (e.g. upward) from the ambient light sensor 92. Thus, the display 90 includes ambient light sensor compensation logic 96 that is used to substantially remove the display brightness from the received light measurements. In At least a portion of the ambient light sensor compensation logic 96 may be located outside the display 18. For example, at least a portion (e.g., processor) of the ambient light sensor compensation logic 96 may be located somewhere else within the electronic device 10. As discussed below, the ambient light sensor compensation logic 96 sub-divides the display 90 into overlapping regions 98. The regions 98 include 4 regions 100, 102, 104, and 106. Although FIG. 10 illustrates box-shaped regions, the regions 98 may be assigned into any suitable shape. The ambient light sensor compensation logic 96 adds all of the brightness values in image data in the video image data in an image frame up for each shape. Thus, pixels located in region 100 are added four times for each of the regions 100, 102, 104, and 106. In some embodiments, the ambient light sensor compensation logic 96 calculates this data when an end of active video (EAV) signal is received from active state registers. In some cases, RGB/RGBW values are converted to YUV (or at least luminance Y values), and the brightness value Y is summed over each of the regions.

Furthermore, although the illustrated embodiment includes 4 regions, some embodiments may include 1, 2, 3, or more regions. For example, in some embodiments, the ambient light sensor compensation logic 96 may subdivide the display into 16 regions. When the regions are box shaped, each region may defined by location and size. The location may be defined as horizontal and vertical offsets from a reference point (e.g., the top left corner) of the input frame. The size may be defined as a region width and a region height. Thus, each box region may be defined by a grid location and a size. In some embodiments, such data may be allocated 30 bits with a maximum frame size of 480×480 with a max width/height bit allocation of 9 and maximum brightness bit allocation of 12.

As noted above, the ambient light sensor stats may be captured on end of active video (EAV) from the live registers to a set of active stats registers, which remain valid until the next EAV. The ambient light sensor states may be "snapshotted" by saving a snapshot version of the ambient light sensor stats in a snapshot register to ensure that the ambient light sensor stats are not updated while the processor 12 is accessing them. When a capture mode is set, the snapshot register gets copied from the sum register storing the summations on the next cycle after the capture mode bit is set. If the capture mode bit is asserted while the sum register is being updated from the live registers at EAV, the copy to the snapshot register is delayed till the update of the sum register is completed. The frame number corresponding to the copy in the snapshot register is captured in a frame number register to indicate to which frame the snapshot register refers. The ambient light sensor stats in the snapshot register remain valid until the capture mode is set again. This way snapshot register can safely be read by the processor 12 regardless of whether the ambient light sensor stats are changing in the sum register.

Figure 11:
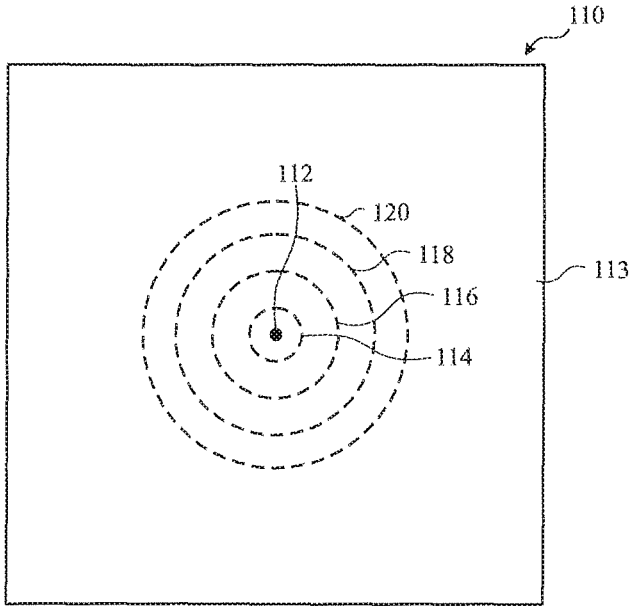
FIG. 11 illustrates a display with an ambient light sensor located behind/under an active area for the display with circular regions, in accordance with an embodiment.

FIG. 11 illustrates a display 110 that includes an ambient light sensor 112 behind an active area 113 that is logically subdivided into circular regions 114, 116, 118, and 120 that corresponds to subdivisions in the image data itself. That is, given a particular location of the ambient light sensor in the display, the image data that is going to be displayed on the display may be subdivided in these concentric regions for the purposes of estimating the effect of the light emitted by the display on the ambient light sensor. Moreover, as illustrated, the ambient light sensor 112 is located away from an edge of the display 110.

Figure 12A:
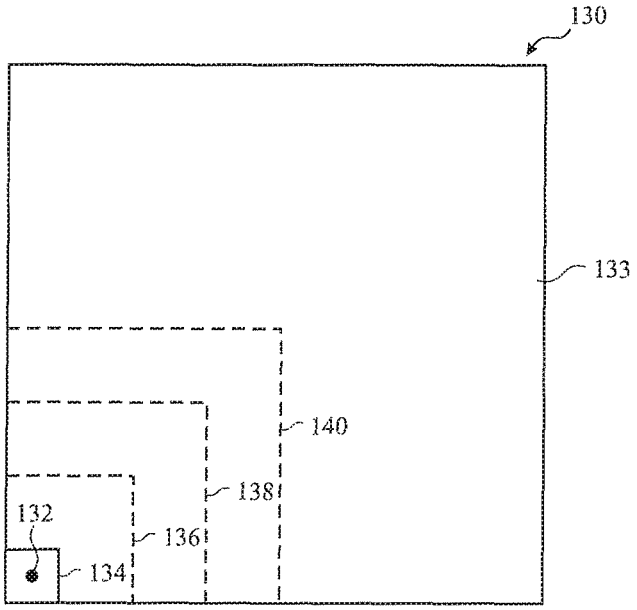
FIG. 12A illustrates a display that includes an ambient light sensor near a corner of the display behind an active area that is logically subdivided into rectangular regions, in accordance with an embodiment.

FIG. 12A illustrates a display 130 that includes an ambient light sensor 132 behind an active area 133 that is logically subdivided into rectangular regions 134, 136, 138, and 140. As illustrated, the ambient light sensor 132 is located near a corner of the display 130.

Figure 12B:
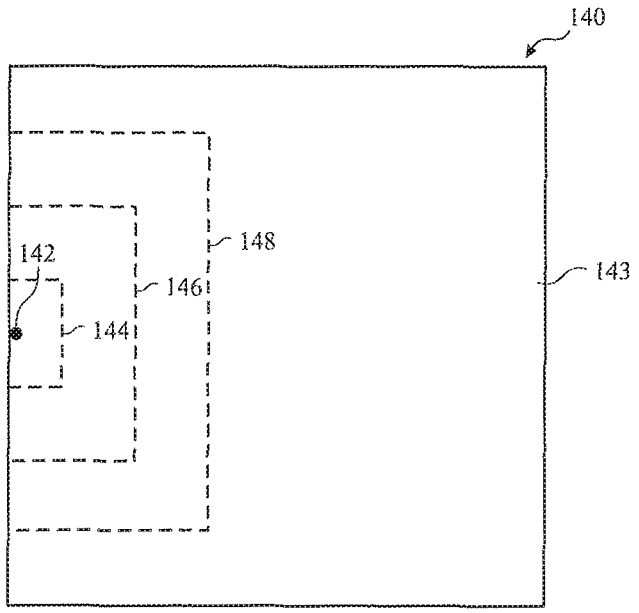
FIG. 12B illustrates a display that includes an ambient light sensor near an edge of the display behind an active area that is logically subdivided into rectangular regions, in accordance with an embodiment.

FIG. 12B illustrates a display 140 that includes an ambient light sensor 142 behind an active area 143 that is logically subdivided into rectangular regions 144, 146, and 148. As illustrated, the ambient light sensor 142 is located near an edge of the display 140.

Figure 13A:
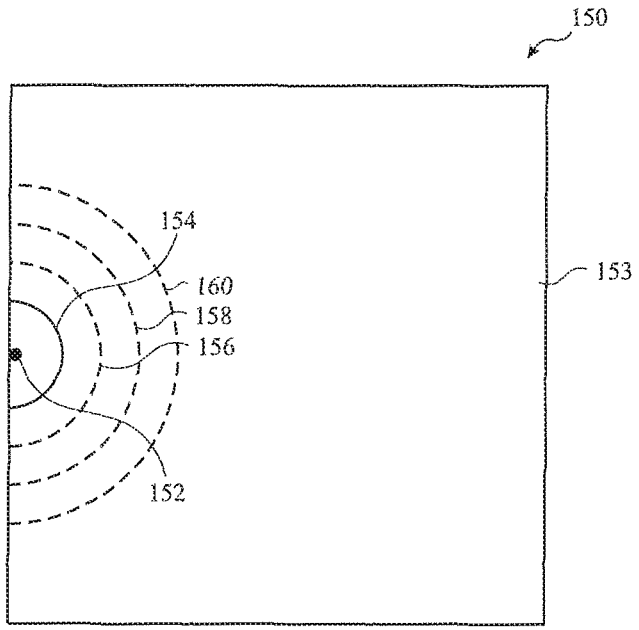
FIG. 13A illustrates a display that includes an ambient light sensor near an edge of the display behind an active area that is logically subdivided into circular regions, in accordance with an embodiment.

FIG. 13A illustrates a display 150 that includes an ambient light sensor 152 behind an active area 153 that is logically subdivided into circular regions 154, 156, 158, and 160. As illustrated, the ambient light sensor 152 is located near an edge of the display 150.

Figure 13B:
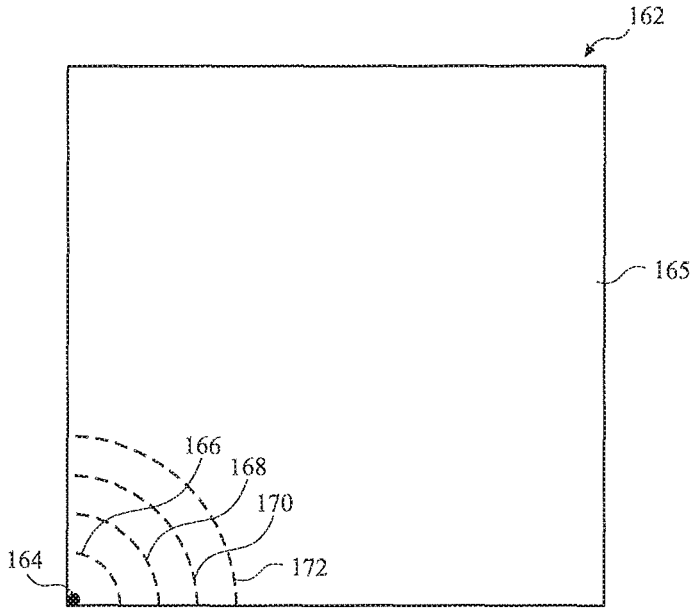
FIG. 13B illustrates a display that includes an ambient light sensor near a corner of the display behind an active area that is logically subdivided into circular regions, in accordance with an embodiment.

FIG. 13B illustrates a display 162 that includes an ambient light sensor 164 behind an active area 165 that is logically subdivided into circular regions 166, 168, 170, and 172. As illustrated the ambient light sensor 164 is located near a corner of the display 162.

Figure 14:
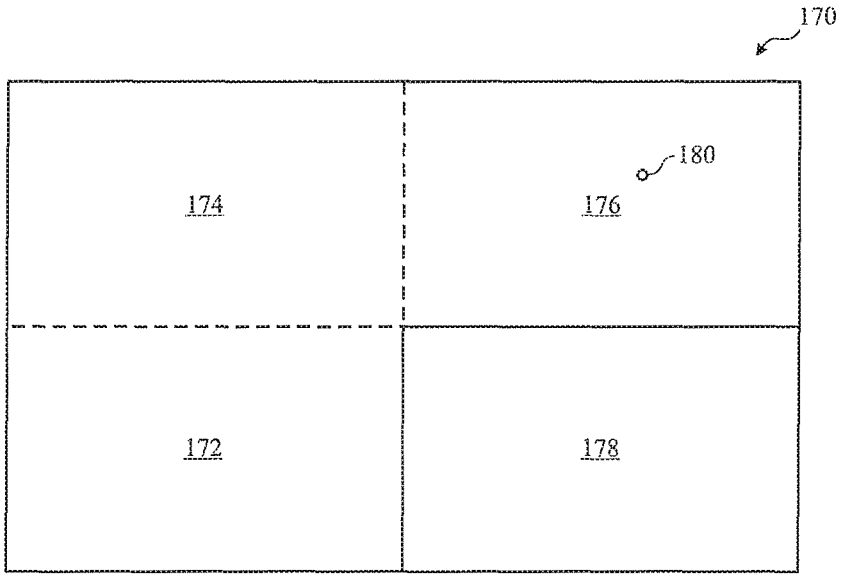
FIG. 14 illustrates a display that includes an ambient light sensor near a corner of the display behind an active area that is logically subdivided into adjacent rectangular regions, in accordance with an embodiment.

Although the foregoing embodiments illustrate overlapping or concentric regions, the regions may not overlap in some embodiments. For example, adjacent regions may have no area of overlap. Furthermore, the adjacent regions may abut against each other or there may be some space between the regions. FIG. 14 illustrates a display 170 that includes logical subdivision into regions 172, 174, 176, and 178. As illustrated, the regions 172, 174, 176, and 178 do not overlap, but the regions 172, 174, 176, and 178 abut against each other. Moreover, the display 170 includes an ambient light sensor 180 that falls within the region 176. Thus, in some embodiments, a summation of image data brightness values may weight brightness values that correspond to the region 176 more heavily than brightness values in regions 174, 178, or 172. For example, the brightness values corresponding to region 176 may be weighted as 2× while brightness values corresponding to regions 174 and 1778 may be weighed as 1× and brightness values corresponding to region 172 may be weighted 0×. Furthermore, although the foregoing illustration includes four logical regions, in some embodiments, the number of regions may be more or less than four. For example, the number of adjacent regions may include 2, 3, 4, 5, 6, 7, or more regions in some embodiments.

Figure 15:
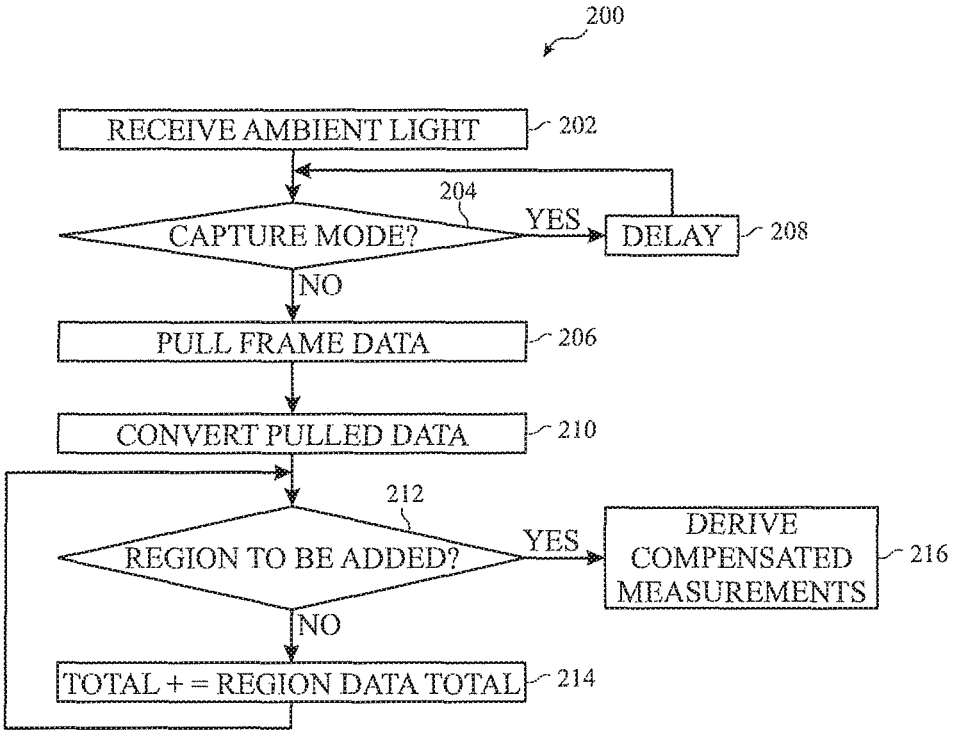
FIG. 15 illustrates a process for using the display with an ambient light sensor behind or under an active area of the display, in accordance with an embodiment.

FIG. 15 illustrates a process 200 for using the display 18 with an ambient light sensor 19 behind/under an active area of the display 18. The process 200 begins by receiving ambient light at the ambient light sensor 19 (block 202). The ambient light sensor compensation logic 80, 96 also determines whether a capture mode is active (block 204). For example, the ambient light sensor compensation logic 80, 96 may determine whether a capture mode bit is set, and a snapshot register is currently being populated with image frame data. If the capture mode is inactive, snapshot data is pulled from a snapshot register (block 206). If the capture mode is active, snapshot data retrieval is delayed until the display the capture mode is inactive (block 208). In other words, the snapshot retrieval is delayed until the snapshot register update has been completed.

The pulled data may be converted from a first format to a second format (block 210). For example, the pulled data may have gamma information and the pulled data is submitted to a digamma algorithm. Additionally or alternatively, the pulled data may be in data format that does not have luminance data directly accessible. For example, the pulled data may be in an RGB/RGBW format. These data formats may be converted from the first format to the second format (e.g., YUV) to make the luminance data directly accessible. The ambient light sensor compensation logic 80, 96 determines whether any regions are yet to be added to the summation for the frame stored in a sum register (block 212). If any region is to be added, the total luminance of the pixels in the region are added to the sum register (block 214).

As previously discussed, these regions may be any suitable shape (e.g., rectangular, circular) and overlap. For example, the regions may be concentric rectangles of varying sizes such that the display weights display pixel brightnesses near the ambient light sensor more heavily than display pixel brightnesses further from the ambient light sensor. In other words, the regions are arranged such that closer pixel brightnesses are captured in more regions because the closer pixels have more effect on the ambient light measurements of the ambient light sensor. The summed brightness data is then subtracted from the ambient light sensor measurements (block A7). In some cases, some ratio (e.g., 1, ½, etc.) of the brightness data is deducted from the received ambient light sensor measurements to derive a compensated ambient light sensor measurement. This compensated ambient light sensor measurement data may be used to relatively accurately drive functions of the display such brightness levels, power settings, and/or other features while using an ambient light sensor under the display that uses enables a screen to cover more of a surface of the display without sacrificing the ambient light sensor or its accuracy.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

a display panel comprising a plurality of pixels each configured to emit light with a plurality of regions;

an ambient light sensor arranged behind the display panel to measure ambient light; and an ambient light sensor compensator configured to estimate how much light detected by the ambient light sensor can be attributed to the emitted light based at least in part on weighting data corresponding to pixels of the plurality of pixels that are closer to the ambient light sensor more heavily than data corresponding pixels of the plurality of pixels that are farther from the ambient light sensor according to which region of the plurality of regions the respective pixels are in, wherein the plurality of regions comprises overlapping regions in which at least one pixel of the plurality of pixels is included in at least two regions of the plurality of regions.

2. The electronic device of claim 1, wherein the overlapping regions comprises rectangular-shaped regions.

3. The electronic device of claim 1, wherein the plurality of regions comprises concentric regions.

4. The electronic device of claim 3, wherein the regions comprise rectangular-shaped regions.

5. The electronic device of claim 1, wherein the ambient light sensor compensator is configured to determine how much of measured ambient light can be attributed to ambient brightness from outside the electronic device by removing at least a portion of the light emitted from the display panel from the measured ambient light to determine how much of the measured ambient light is properly attributed to the ambient brightness from outside the electronic device.

6. The electronic device of claim 5, wherein the ambient light sensor compensator is configured to track each region using an offset from a reference point of the display panel and a size of the region.

7. A method comprising:

dividing a plurality of pixels in an active area of a display into a plurality of regions;

capturing ambient light measurements from received light using an ambient light sensor located behind the active area of the display relative to where the display is to be viewed, wherein the received light comprises display light from the active area and ambient light from outside the display;

determining summations of pixel luminance for at least one region of the plurality of regions in a video frame from image data, wherein the plurality of regions comprises overlapping regions, wherein at least one pixel of the plurality of pixels is included in at least two adjacent regions of the plurality of regions; and estimating how much light detected by an ambient light sensor behind the plurality of pixels can be attributed to light emitted from the display.

8. The method of claim 7 comprising:

reducing contribution of the display light to the ambient light measurements based at least in part on the determined summations of pixel luminance to provide compensated ambient light measurements; and setting an intensity setting of a backlight based at least in part on the compensated ambient light measurements.

9. The method of claim 7, comprising:

determining if a capture mode is active, wherein the capture mode indicates whether a frame is currently being written to a snapshot register;

if the capture mode is inactive, copy data; and if the capture mode is active, delay copying until the capture mode is inactive.

10. The method of claim 9, wherein determining whether the capture mode is set comprises determining that a capture mode bit is set for the display.

11. The method of claim 9 comprising:

receiving image data is received from a register that stores display pixel data in a first format that does not explicitly indicate luminance values; and converting the image data from the first format to a second format that has an explicit luminance value.

12. The method of claim 11, wherein the first format comprises an RGB format and the second format comprises a YUV format.

13. An electronic device comprising:

a display having an active area comprising at least one region comprising a plurality of pixels each configured to emit light;

an ambient light sensor configured to measure luminance of light received at the ambient light sensor, wherein the light comprises light from outside of the display and light emitted from the display; and an ambient light sensor compensator configured to:

acquire luminance measurements from the ambient light sensor;

acquire pixel brightness values for at least a portion of the display;

determine pixel brightness values in image data for each pixel of the plurality of pixels corresponding the at least one region of the display based at least in part a distance of a respective region of the at least one region from the ambient light sensor, wherein the at least one region of the display comprises overlapping regions where at least one pixel of the plurality of pixels is included in at least two adjacent regions of the at least one region of the display; and compensate the luminance measurements based at least in part on the determined pixel brightness values for light emitted by the plurality of pixels.

14. The electronic device of claim 13, wherein the overlapping regions comprise rectangular or circular shaped regions.

15. The electronic device of claim 13, wherein the plurality of pixels comprises organic light emitting diodes.

16. The electronic device of claim 13, wherein compensating the luminance measurements comprises reducing a contribution of the light emitted by the plurality of pixels from the luminance measurements.

17. The electronic device of claim 13, wherein the at least one region comprises a plurality of adjacent regions.

18. The electronic device of claim 13, wherein the ambient light sensor compensator is configured to:

determine whether a capture mode is active, wherein the capture mode indicates whether a frame of the image data is currently being written to a snapshot register;

when the capture mode is inactive, copy data; and when the capture mode is active, delay copying until the capture mode is inactive.

* * * * *